US007234633B2

(12) United States Patent
Day et al.

(10) Patent No.: US 7,234,633 B2
(45) Date of Patent: Jun. 26, 2007

(54) SECURING AND HANDLING OF MAIL

(75) Inventors: Thomas Day, Vienna, VA (US); Leland Ray Jones, LaPlata, MD (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 10/287,275

(22) Filed: Nov. 1, 2002

(65) Prior Publication Data

US 2003/0106929 A1 Jun. 12, 2003

Related U.S. Application Data

(60) Provisional application No. 60/330,889, filed on Nov. 2, 2001.

(51) Int. Cl.
*A47G 29/12* (2006.01)

(52) U.S. Cl. ..... 232/30; 232/43.2; 232/45

(58) Field of Classification Search ..... 232/30–32, 232/43.2, 45, 17

See application file for complete search history.

(56) References Cited

U.S. PATENT DOCUMENTS

| | | | | | |
|---|---|---|---|---|---|
| 237,315 | A * | 2/1881 | Paul | 232/31 |
| 329,293 | A * | 10/1885 | Ehrlich | 232/31 |
| 378,955 | A * | 3/1888 | Dubey | 232/30 |
| 461,381 | A * | 10/1891 | Richter | 232/30 |
| 718,717 | A * | 1/1903 | Marx et al. | 232/32 |
| 1,027,524 | A * | 5/1912 | Cook | 232/30 |
| 1,256,044 | A * | 2/1918 | Schilling | 232/31 |
| 1,451,343 | A * | 4/1923 | Panagopolous | 232/30 |
| 2,144,323 | A * | 1/1939 | Bienz | 232/30 |
| 2,421,221 | A * | 5/1947 | Rothe | 232/30 |
| 2,468,897 | A * | 5/1949 | Rothe | 383/22 |
| 3,300,128 | A * | 1/1967 | Jasinksi et al. | 232/17 |
| 3,854,656 | A * | 12/1974 | Bishop et al. | 232/27 |
| 4,363,438 | A * | 12/1982 | Connor | 232/30 |
| 4,785,960 | A * | 11/1988 | Belisle | 220/23.83 |
| 4,802,773 | A | 2/1989 | Gross | |
| 5,137,212 | A * | 8/1992 | Fiterman et al. | 232/43.2 |
| 5,645,353 | A | 7/1997 | Linnell et al. | |
| 5,915,618 | A | 6/1999 | Gaudet | |
| 6,123,257 | A | 9/2000 | Guidicy | |
| 6,367,294 | B1 | 4/2002 | Pauley | |
| 6,390,021 | B1 * | 5/2002 | Krenzel | 119/52.2 |
| 6,533,167 | B2 * | 3/2003 | Hassan | 232/45 |
| 6,585,130 | B2 * | 7/2003 | Turbett et al. | 221/45 |

* cited by examiner

*Primary Examiner*—William L. Miller
(74) *Attorney, Agent, or Firm*—Bradley K. DeSandro; Lewis and Roca LLP

(57) ABSTRACT

A biohazard-isolating bag is positioned in the interior space of a public mailbox. The biohazard-isolating bag receives mail that is deposited in the mailbox. A postal worker, upon retrieving mail from the mailbox, closes the biohazard-isolating bag. Contaminants that may be carried by letters or mailpieces are thereby contained within the bag and isolated from the environment exterior of the bag. The contents of the biohazard-isolating bag may be safely transported for further decontamination or processing.

20 Claims, 4 Drawing Sheets

SECURING AND HANDLING OF MAIL

CROSS-REFERENCE TO RELATED APPLICATIONS

This application claims priority from U.S. Provisional Application No. 60/330,889 filed on Nov. 2, 2001, entitled "Securing and Handling of Mail." The contents of the above provisional application is relied upon and expressly incorporated by reference as if fully set forth herein.

STATEMENT REGARDING FEDERALLY SPONSORED RESEARCH OR DEVELOPMENT

The invention was made by an agency of the United States government or under a contract with an agency of the United States government, the United States Postal Service ("USPS" or "Postal Service"), an independent establishment of the executive branch of the U.S. government.

BACKGROUND OF THE INVENTION

1. Field of the Invention

The present invention relates to methods for depositing and retrieving mail into and from a mailing receptacle. More particularly, the present invention relates to equipment and procedures associated with the mailing process whereby handling mail is done in a secure method in order to guard against potential biohazards in contaminated mail.

2. Description of the Related Art

The United States Postal Service provides mail collection boxes in a multitude of public locations where members of the public may deposit mail items. Indeed this is true throughout the world; national postal authorities make public mailing receptacles open to the public. One of the chief design criteria for the public mailbox has been easy access and usability by the public.

In addition, the postal carriers and individuals who access public mailboxes typically do so in a hurried manner with little if any thought to potential hazards that may wait inside them. Thus the public mailbox makes an inviting target for those bent on anonymous and antisocial behavior.

These mailboxes have occasionally been the targets of pranks and vandalism. Recently there was a spate of more serious incidents involving contaminated mail. It is believed that mail was deposited and delivered through typical mail channels where the mailpieces had been deliberately contaminated with biological hazard material. Investigation has confirmed that some mailpieces deposited in mailboxes were contaminated with anthrax spores. Some members of the postal service, as a result of their handling contaminated mail, suffered exposure to the biological materials.

In response to these incidents, procedures have been developed to treat mail that is believed to be contaminated with biohazard or infectious materials. Decontamination methods have been developed that will render contaminated mail safe or harmless. However, application of these decontamination methods typically requires that suspected mail be transported from a collection location to a decontamination site. Thus, even with present decontamination procedures, there exists a risk of exposure to harmful agents within the mail while the mail is in transport to the decontamination site. Thus, there is a need to develop equipment and methods to minimize the chance of infection or exposure to biohazard material in the mail during the period between mail collection and decontamination.

The present mailbox design provides little protection against the threat posed from biohazards in contaminated mail. Accordingly, there is a need to improve the mailbox design. In addition, there is a need to develop practices and methods whereby letter carriers may perform their duties in a safe and secure manner.

It would be desirable to provide a means whereby contaminated mail in a mailbox can be collected with minimal risk of human exposure to infectious material potentially found in the mail.

It would also be desirable to retrofit the existing mailbox design such that mailboxes need not be replaced in their entirety. It would be advantageous to provide a means for secure handling of mail that can be applied to the mailbox design that is now in use.

It would also be desirable to provide a method to improve security in postal collection that can be enacted quickly and easily.

SUMMARY OF THE INVENTION

The present invention overcomes deficiencies in mailbox design by providing a means to contain the contents of a mailbox in a biohazard isolating receptacle. The containment allows the contents of a mailbox to be collected and transported with minimized exposure of mailpieces with the surrounding air environment. The secure handling can further be applied to mailboxes as presently designed and in use in the field. The secure handing technique is further simple in concept and design and can be quickly applied and retrofitted to present equipment.

Accordingly it is an object of the present invention in one aspect to provide a biohazard-isolating bag that is positioned in the mailbox.

It is a further object of the present invention to provide a means whereby a biohazard-isolating bag may be securely closed. The closure isolates the contents of the bag from the environment. In this manner any potential contamination in a mailpiece is confined to the interior of the bag. Potential exposure of the contamination to the public is minimized.

An additional object of the present invention is to provide a method of attaching a biohazard-isolating bag to the interior of a mailbox. The attachment method allows the present mailbox design to remain essentially unchanged so that conventional and customary methods of depositing and collecting mail are not affected.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed. Thus, the present invention comprises a combination of features, steps, and advantages which enable it to overcome various deficiencies of the prior art. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of a preferred embodiment of the present invention, reference will now be made to the accompanying drawings, which form a part of the specification, and wherein.

DETAILED DESCRIPTION OF THE PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

Figure 1:
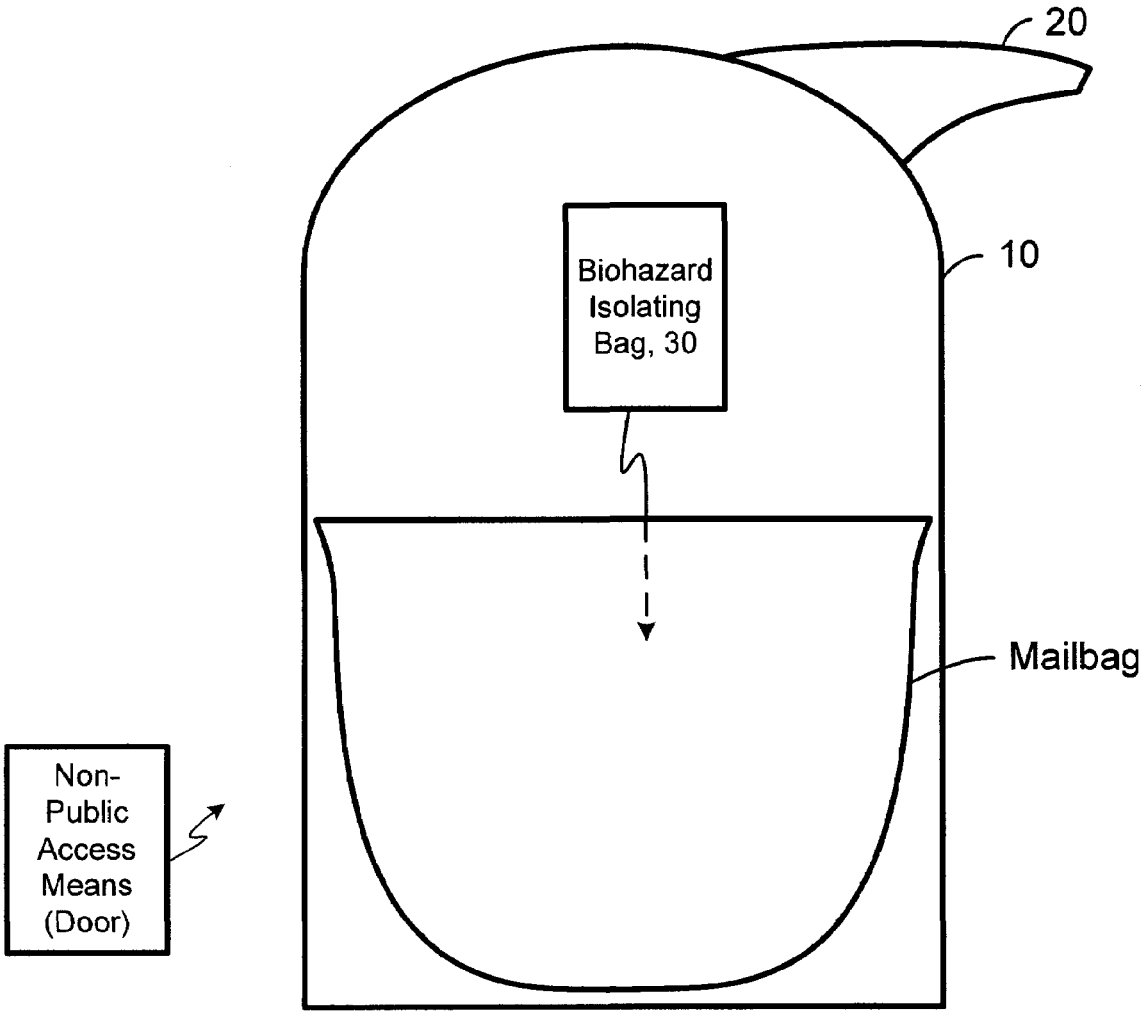
FIG. 1 is a side view of a postal mailbox with a biohazard liner in place where the outer wall of the mailbox is removed to show its interior.

Referring to FIG. 1 there is shown a schematic view of a biohazard isolating bag positioned inside a postal mailbox. Mailbox 10 is a conventional postal mailbox. Such a mailbox is typically rectangular in vertical profile and square or rectangular in horizontal profile although other configurations are possible. Mailbox 10 includes deposit door 20. Mailbox 10 also includes at the rear of the mailbox 10 a non-public access means, such as a door, through which a postal worker accesses the contents of mailbox 10. As is customary, mailbox 10 defines an interior space and an exterior space. When rectangular in shape, mailbox 10 includes four walls a top and bottom.

Biohazard-isolating bag 30 (sometimes hereinafter referred to as "bag") is positioned in the interior of mailbox 10. Biohazard isolating bag 30 is preferably made of flexible plastic. Preferable plastic materials include polyvinyl chloride (PVC), polyethylene, polypropylene, and copolymers of polyethylene and polypropylene. The thickness of bag 30 is sufficient for multiple purposes. In a first aspect, the bag thickness must be sufficient to provide mechanical strength and integrity required for the bag's purposes. Additionally, the bag must be of sufficient thickness in order to provide a suitable barrier to isolate the interior contents of bag 30 from the exterior environment.

Biohazard-isolating bag 30 may also be used as a liner fitting inside of another, exterior bag. Thus, for example, a biohazard-isolating bag may be used in conjunction with traditional canvas or cloth mailbags. When used in such an arrangement, biohazard-isolating bag 30 is placed in the interior of another mailbag. Together bag 30 and the mailbag may be positioned inside mailbox 10.

The shape of bag 30 may assume different sizes and shapes. Generally bag 30 conforms to the interior shape of mailbox 10. Thus bag 30 may also take on different sizes and shapes depending on the size and dimensions of the mailbox. In a preferred embodiment the bag generally may assume the shape of an open rectangular box, corresponding to the interior shape of a standard postal mailbox. Bag 30 may also be semiovoid or elliptical in shape. In another embodiment the shape of bag is generally rounded with circular walls and a round bottom. The walls of bag 30 generally define an interior space and an exterior space. One end of bag 30 defines an opening, and the other side of bag 30 is closed.

In a preferred embodiment mailbox 10 and bag 30 include reciprocal attachment means by which to affix bag 30 to the interior of mailbox 10. In one embodiment rails 40 are located on inner surfaces of mailbox 10. Attachment rails 40 provide a means by which bag 30 may be secured to the interior of mailbox 10. Corresponding slides are positioned on bag proximate to bag opening.

Figure 2A:
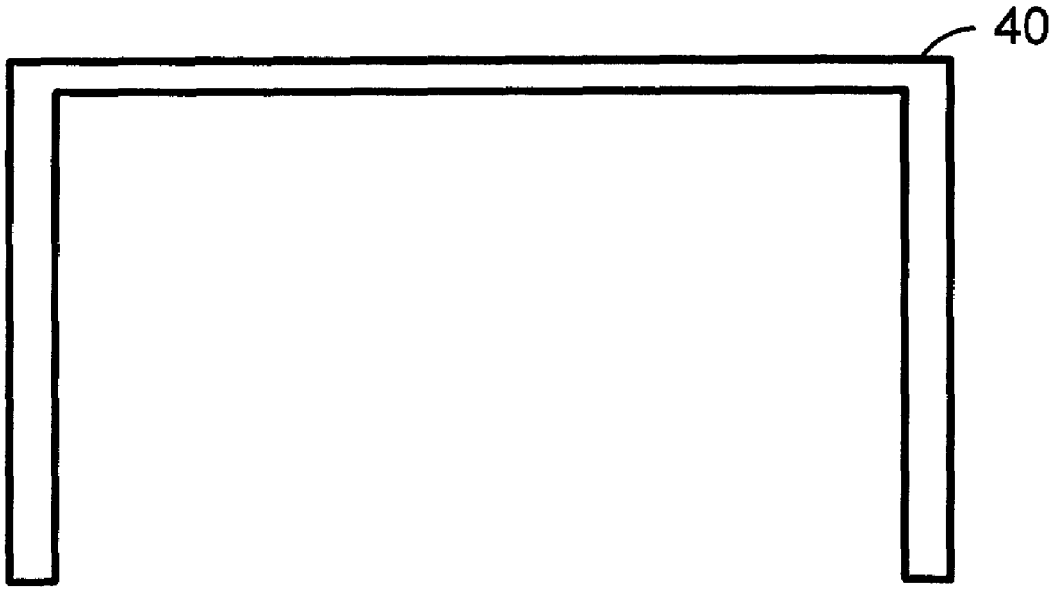
FIG. 2*a* is a top view of the rails used to affix a liner bag to the interior of a mailbox.

As shown in FIG. 2*a* rails may be attached to interior walls of mailbox 10. As shown in this figure rails are affixed to the front wall and two side walls of mailbox 10. No rail is attached to the rear wall of mailbox 10 as this wall also typically serves as the access door 20 to mailbox 10. While it is preferred to provide rails 40 on three walls of mailbox 10 other arrangements are possible. For example only two walls may include such rails 40. Further rails 40 preferably extend along a substantial length of each wall, although they need not do so. The purpose of rails 40 is to support bag 30, and the necessary support my be achieved in rails that only extend along a partial length of the wall.

Figure 2B:
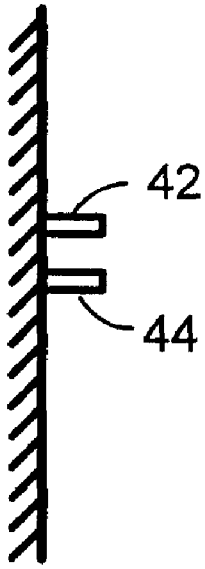
FIG. 2*b* is a side view of one embodiment of rails shown attached to a side wall of a mailbox.

FIG. 2*b* illustrates rails 40 as affixed to a mailbox wall in side view. Rail 40 comprises an upper lip 42 and lower lip 44. The space between upper lip 42 and lower lip 44 defines a groove. Support slides, not shown, engage rails 40 by fitting within the groove between upper lip 42 and lower lip 44. The slides are sturdy and rigid enough so as to provide a means by which to support the opening of bag 30 resting within rails 40. The slides may be attached to bag 30. The slides may, for example, fit within a pocket provided in bag 30 for receiving the slides. Alternatively, the slides may provide a friction fit such that bag 30 is held in place between rails 40 and corresponding slides by a pinching or friction effect. In practice the engagement between slides and rails 40 defines the opening shape of bag 30 when bag is positioned in place.

Rails 40 may be affixed to mailbox 10 using several known methods. Such methods include welding, bolting, gluing, and clamping. Also rails 40 may comprise any material such as metal, plastic, wood, or composite so long as it provides the necessary strength and rigidity to support bag 30, including when the bag is loaded with mail.

The rails are positioned at an interior position of the mailbox in order for the bag to hang in a desired location. In a preferred embodiment the preferred location of the bag is such that the bag opening is proximate the mailbox opening. In this manner the volume of the bag tends to approximate the corresponding volume of the mailbox.

Another preferred embodiment includes velcro as a support means. In this embodiment strips of velcro are affixed to interior walls of mailbox 30 where, for example, rails 40 have been described as being positioned. Reciprocal strips of velcro are attached to bag 30, proximate bag opening. Bag 30 is thus positioned in the desired position in the interior of mailbox 10 by contacting or engaging strips of velcro on bag 30 to corresponding strips of velcro on mailbox 10.

The attachment means provides a level of contact between the bag and the interior walls of the mailbox. The contact is such that when a mailpiece is deposited in mailbox 10 through deposit door 20, the mailpiece will tend to fall toward the interior space of bag 30. Generally a mailpiece will not fall outside the bag by passing between the bag and the interior wall of the mailbox. In this manner a mailpiece carrying a contaminant will fall into bag 30 where it can be isolated.

Other options may be used to position bag 30 in mailbox 10. Bag 30 may be hung from hooks or clamps positioned on the interior walls of mailbox 10. Additionally, bag 30 may be supported on a self-standing support framework that is not itself physically attached to mailbox 10. Thus a support frame may provide an attachment means such as rails, hooks, velcro, or some other supporting method. The support frame rests in mailbox 10, but is not affixed to the mailbox. Bag 30 is then positioned in the interior of mailbox 10 by affixing it or the attachment means provided on the support frame. The self-standing frame described in this paragraph may be an attractive method to deploy the biohazard-isolating bag 30 of this invention for one reason. A self-contained support may be installed with no need to retrofit anything to the mailbox structure itself. However, the self-standing attachment frame is for another reason less attractive than a means that is physically attached to mailbox 10. A self-standing support frame does not provide as close a contact between bag 30 and walls of mailbox 10 as does the attachment means that is physically part of mailbox 10.

Figure 3:
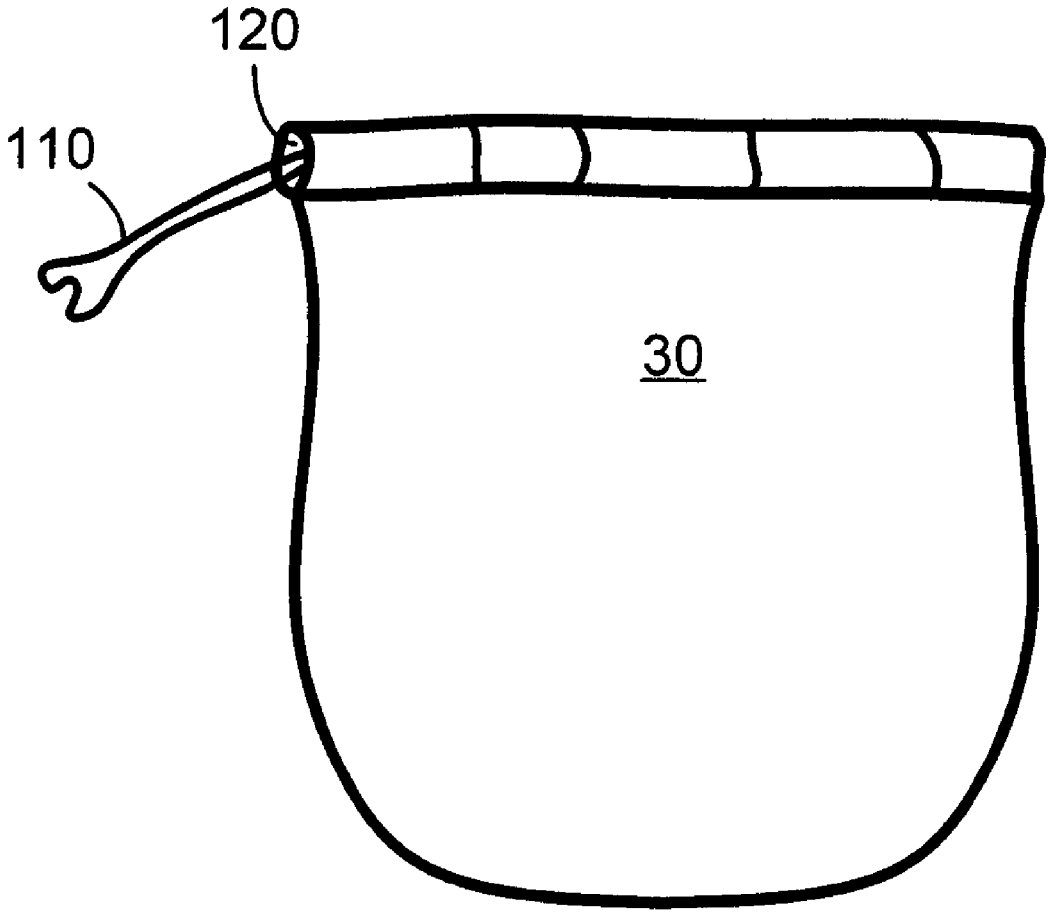
FIG. 3 is a perspective view of a mailbag with a drawstring for closing the mailbag.

In a preferred embodiment bag 30 includes closure means. Referring to FIG. 3 closure means may comprise a drawstring 110 and raceway 120 that encircle bag 30. Drawstring 110 may comprise any kind of elastic and flexible material such as cotton, fabric (synthetic and natural) blends, polymers, and metals. Raceway 120 comprises a channel or passage through which drawstring 110 passes. Raceway 120 may be formed of the same material as bag 30. Alternatively, raceway 110 may be formed of material different from that of bag 30 such as a fabric material. Raceway 120 should provide sufficient clearance so that drawstring 110 can move freely within raceway 120. Drawstring 110 may be drawn tight so that it tightly closes the opening of bag 30.

Preferably drawstring 110 and raceway 120 are positioned near the top of bag 30 as shown in FIG. 1. In such a position drawstring 10 and raceway 120 encircle the opening of bag 30. Placement of drawstring 110 and raceway 120 in such a position allows maximum use of the space in bag 30 to receive and carry mail.

In an alternate preferred embodiment bag closure means comprises a mechanical zipper. Said zipper may be of plastic or metallic composition.

Figure 4:
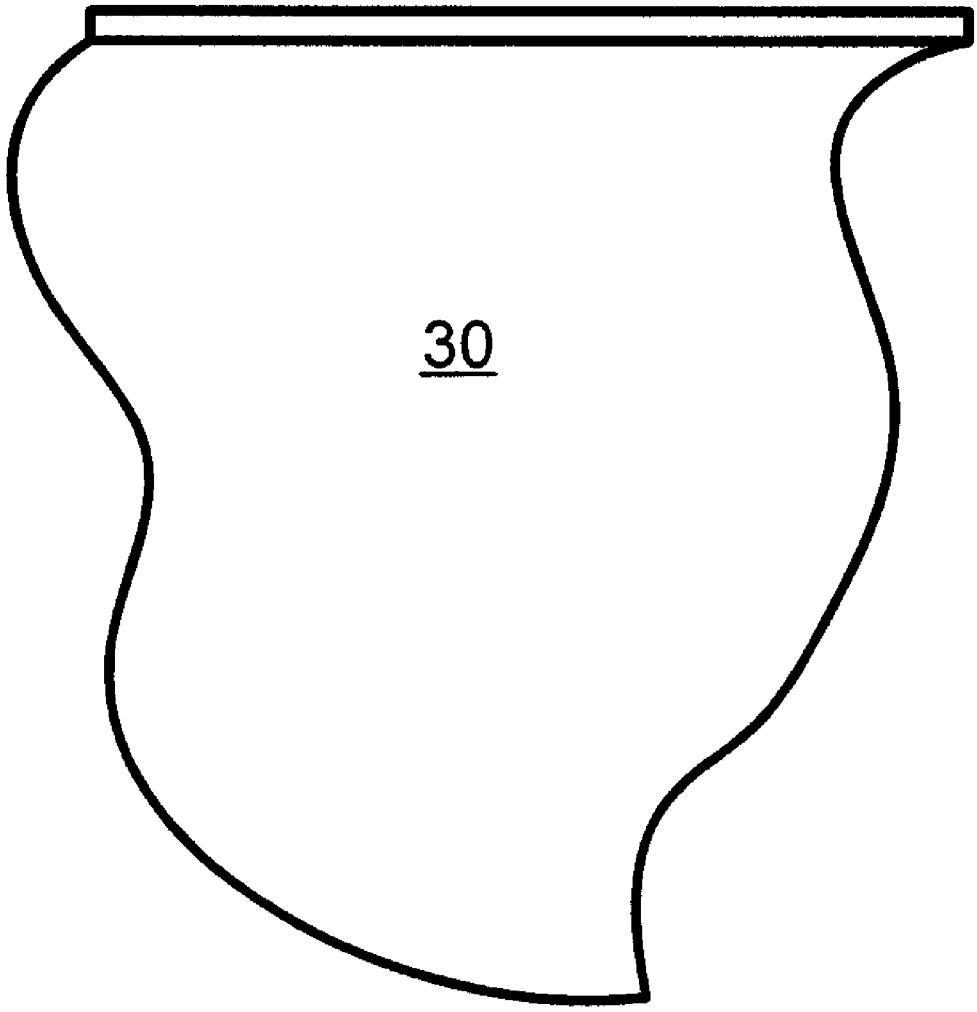
FIG. 4 is a perspective view of a mailbag showing a ziplock means to close the mailbag.

In another preferred embodiment the opening of bag 30 comprises a plasticized ziplock closure. FIG. 4 shows biohazard-isolating bag 30 when closed by means of an interlocking engagement, or ziplock, closure. The ziplock closure is known in the art as a method by which to provide a seal between plasticized sheets. The ziplock closure comprises interlocking ridges on opposing sheet faces. Pressing the opposing faces together forces the ridges to engage in interlocking fashion. The ziplock closure may be preferred in some applications for the high quality of its seal compared to other methods of closure. The ziplock closure may provide a substantially airtight seal. In practice a bag 30 with a ziplock closure is positioned in a mailbox as described above. Bag 30 has interlocking ridges that provide a ziplock closure positioned proximate the opening of bag. When removing bag 30, a postal employee presses opposing faces of bag 30 so as to interlock the engaging ridges. In this manner the contents of bag 30 are isolated from the external environment.

The seal effected by the closure means provides a substantial level of isolation of the contents of bag 30 from the outside environment. Different closure means may provide different levels of isolation. Thus, for example, a ziplock closure may provide a nearly airtight seal between the interior of bag 30 and the exterior. A drawstring closure, by contrast, in the closed position will not necessarily provide a completely airtight seal. Nevertheless, both kinds of closures may be appropriate for use in the invention. The level of isolation provided by the biohazard isolating bag 30 need not rise to the level of isolation that is found in a medical or research environment dealing with infectious germs. Rather, the level of isolation provided by biohazard isolation bag 30 is a substantial level of isolation such that the degree of exposure of biohazard material to humans is reduced by isolating such contaminants in bag 30.

An alternative method for closing bag 30 may be used in conjunction with the slide framework. A lid may be fashioned that matches the opening defined by the slide/rail engagement. The lid is positioned over the bag opening so as to provide a barrier between the interior of bag 30 and the exterior environment. When a postal employee opens the mailbox through the access door, the lid would be positioned. An additional closure of bag 30 is obtained by tightening the drawstring around the lid. The bag is thereupon removed.

The bag possesses sufficient mechanical strength to withstand the wear and tear associated with receiving mail. In a preferred embodiment a polyethylene bag is up to 50 mils thick. The bag retains its integrity when subjected to a load of mail. The bag withstands being removed and carried to a mail truck without tearing or ripping.

In operation a biohazard-isolating bag is positioned in the interior of a mailbox. The bag may be secured by affixing attachment means on the bag to the receiving means on the interior of the mailbox. During use mailpieces that are deposited into the mailbox will fall into the interior of bag. At time for pickup, a postal employee accesses the mailbox through access door. In one embodiment, when the mail handler opens the access door of the mailbox, a drawstring is pulled and automatically seals the bag in a single motion. The postal employee detaches the attachment means thus freeing bag from mailbox. Bag is closed by shutting the closure means. The bag is then removed from the mailbox. If desired a fresh bag may be positioned in the mailbox.

A benefit can be achieved by limiting the jostling that a mailpiece receives while the mailpiece is exposed to the open environment. Where, for example, a mailpiece is contaminated with a microbial agent, the ability of the microbe to infect a human being is increased when the contaminant becomes airborne. Conversely, the danger presented by an infectious microbe is minimized so long as that contaminant remains on a solid surface and does not become airborne. In the former case, infection can occur by breathing, ingestion, or skin contact with the microbial agent. In the latter case, where the infectious microbe remains on a surface, human contact with that surface would be the means of transmission. A jostling or shaking of a contaminated mailpiece, while it is open to the air, may provide the energy for a microbe to pass from the contaminated surface of a mailpiece to the air environment. While it may be impractical to eliminate jostling of a mailpiece altogether, the mailpiece can be isolated from the environment such that if contamination were to become airborne it would at least remain confined within the isolating enclosure.

It is to be understood that the present invention may be used in conjunction with other methods to render contaminated mail safe for human contact. Other known methods, such as radiation exposure or chemical exposure may be needed to cleanse the mail from harmful microbial contamination. Thus in one aspect the present invention provides a means to safely deliver suspect mail from a public mailbox to a decontamination site.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. One of ordinary skill in the art will recognize that the process just described may easily have steps added, taken away, or modified without departing from the principles of the present invention. Accordingly, the scope of protection is not limited to the embodiments described herein, but is only limited by the claims which follow, the scope of which shall include all equivalents of the subject matter of the claims.

What is claimed is:

1. A mail receptacle comprising:

a mailbox defined by a mailbox exterior having an opening to a mailbox interior;

a mailbag, within the mailbox interior, defined by a mailbag exterior having an opening to a mailbag interior; and, a liner, within the mailbag interior, including:

an opening for receiving mail pieces deposited into the opening of the mailbag through the opening of the mailbox; and means for forming a substantially air-tight compartment enclosing said received mail pieces by closing the opening of the liner, whereby material on any said received mail pieces is substantially prevented from becoming airborne outside the liner.

2. A mailbox comprising:

a housing having an opening to receive mail from the public;

a first container, within and removable from the housing, and having an opening to receive the mail from the opening of the housing; and a second container, within and removable from the first container, and being adjustable between:

an open position thereof at which an opening to the second container can receive the mail from the opening of the housing; and a closed position thereof at which the opening of the second container is not in communication with the opening of the housing; and means for accessing the interior of the housing for removal of the first and second containers.

3. The mailbox as defined in claim 2, further comprising means for maintaining the second container in the open position thereof.

4. The mailbox as defined in claim 3, wherein the means for maintaining the second container in the open position thereof is selected from the group consisting of:

means for removably attaching the second container to the interior of the housing; and a support frame within the interior of the housing.

5. The mailbox as defined in claim 2, further comprising means for adjusting the second container between the open and closed position thereof.

6. The mailbox as defined in claim 2, further comprising means, when the interior of the housing is accessed, for adjusting the second container from the open position thereof to the closed position thereof.

7. The mailbox as defined in claim 2, further comprising:

means for adjusting the second container from the open position thereof to the closed position thereof when the access means provides said access to the interior of the housing.

8. The mailbox as defined in claim 2, wherein the first container is adjustable between open and closed positions thereof with the opening to the first container respectively:

receiving the mail from the opening of the housing; and not being in communication with the opening of the housing.

9. The mailbox as defined in claim 2, wherein the second container, when within the first container, is a liner for the first container.

10. The mailbox as defined in claim 2, wherein the second container, when in the closed position thereof, is substantially airtight.

11. The mailbox as defined in claim 2, further comprising means for making the second container substantially airtight when in the closed position thereof.

12. The mailbox as defined in claim 2, wherein the second container, when within the interior of the housing and in the open position thereof, can assume a conforming shape to the interior of the housing.

13. The mailbox as defined in claim 2, wherein the volume of the interior of the second container, when in the open position thereof, is approximately the same as that of the interior of the housing.

14. A postal receptacle comprising:

means for receiving mail items from the public wherein said means for receiving mail items from the public is a public mailbox;

means for enclosing the received mail items in an inner container that is within an outer container, wherein:

the inner container is substantially airtight when in a closed position thereof; and the outer container is selected from the group consisting of:

a mailbag; and a box into which mail falls when received from the public by way of deposit into the public mailbox; and, means for non-public access to the enclosing means.

15. The postal receptacle as defined in claim 14, further comprising means for adjusting the inner container between the open position thereof and the substantially airtight closed position thereof.

16. The postal receptacle as defined in claim 14, further comprising means, upon opening the non-public access, for adjusting the inner container from the open position thereof to the substantially airtight closed position thereof.

17. The postal receptacle as defined in claim 14, further comprising:

means, when the non-public access door is opened, for adjusting the inner container from the open position thereof to the substantially airtight closed position thereof.

18. The postal receptacle as defined in claim 14, further comprising means for forming a substantially airtight seal at an opening of the inner container when in the substantially airtight closed position thereof.

19. The postal receptacle as defined in claim 14, further comprising means for maintaining the inner container in the open position thereof.

20. The postal receptacle as defined in claim 19, wherein the means for maintaining the inner container in the open position thereof is selected from the group consisting of:

means for removably attaching the inner container inside the public mailbox; and a support frame within the public mailbox.

* * * * *